US005382939A

United States Patent [19]

Hong

[11] Patent Number: 5,382,939

[45] Date of Patent: Jan. 17, 1995

[54] COOKING STATE DISPLAYING APPARATUS AND METHOD FOR A MICROWAVE OVEN COMBINED WITH A TELEVISION

[75] Inventor: Yeong K. Hong, Kyungsangnam, Rep. of Korea

[73] Assignee: Gold Star Co., Ltd., Seoul, Rep. of Korea

[21] Appl. No.: 96,777

[22] Filed: Jul. 23, 1993

[51] Int. Cl.[6] ..... G08B 1/00

[52] U.S. Cl. ..... 340/309.15; 348/156; 348/705; 219/506; 219/720; 345/184; 99/325

[58] Field of Search ..... 340/309.15; 348/156, 348/705; 219/506, 720; 345/184; 99/325

[56] References Cited

U.S. PATENT DOCUMENTS 4,350,860 9/1972 Ueda ..... 219/10.55 B 4,628,351 12/1986 Heo ..... 348/156

5,274,209 12/1993 Edamura ..... 219/10.55 B

*Primary Examiner*—John K. Peng

*Assistant Examiner*—Nina Tong

*Attorney, Agent, or Firm*—Helfgott & Karas

[57] ABSTRACT

A cooking state displaying apparatus and method for a microwave oven combined with a television. The apparatus includes a body sensor for sensing if there is a person near the microwave oven, and in accordance with the sensed output from the body sensor during cooking, selectively displays the current cooking state and completion on an LED displayer installed on the front side of the microwave oven or on a TV screen. Also, in accordance with the sensed output from the body sensor, a cavity lamp in the microwave oven is selectively turned on/off and the loudness of a buzzer sound for indicating completion of cooking varies. Therefore, it is convenient to use and it is possible to save power consumption.

6 Claims, 5 Drawing Sheets

COOKING STATE DISPLAYING APPARATUS AND METHOD FOR A MICROWAVE OVEN COMBINED WITH A TELEVISION

BACKGROUND OF THE INVENTION

1. Field of the Invention

The present invention relates to a microwave oven combined with a television (hereinafter referred to as "TV"), and more particularly to a cooking state displaying apparatus and method which can selectively display the cooking state of a microwave oven on the TV screen.

2. Description of the Prior Art

The conventional cooking state displaying apparatus is generally installed on the front side of a microwave oven and visually displays a cooking state or completion to a user.

As shown in FIG. 1, the conventional cooking state displaying apparatus comprises a microcomputer 10 for controlling the operation of a microwave oven, a cooking state sensing section 20 for sensing a cooking state in order to provide the sensed information to microcomputer 10, a display section 30 for displaying a cooking state in accordance with the sensed information from sensing section 20 under the control of microcomputer 10, and a buzzer driving section 40 for indicating the completion of cooking under the control of microcomputer 10.

FIG. 2 is a detailed circuit diagram of the conventional cooking state displaying apparatus for a microwave oven. Referring to FIG. 2, cooking state sensing section 20 comprises a cooking state sensor RS and a voltage dividing resistor R14, which are connected to analog/digital conversion input terminal AD of microcomputer 10. Moreover, display section 30 comprises transistor arrays 31 and 32, respectively connected to first and second LED (Light Emitting Diode) driving terminals P10 to P16, P20 and P21, a plurality of current limiting resistors R7 to R13, and LED displayers 33 and 34 for displaying cooking state and completion, being driven by the outputs of first and second LED driving terminals P10 to P16, P20 and P21. And, buzzer driving section 40 comprises transistors Q1 and Q2, whose bases are respectively connected to control terminal CL and buzzer control terminal BZ of microcomputer 10, a buzzer 41 driven by transistors Q1 and Q2, and a plurality of bias transistors R1 to R6.

Meanwhile, as a cooking state sensor RS, a gas sensor for sensing the amount of gas generated from food during cooking, a humidity sensor for sensing the variation of humidity in a heating cavity of a microwave oven, and a temperature sensor for sensing the variation of temperature of food or in the heating cavity are usually used.

The operation of the conventional apparatus constructed as above will be explained as follows.

The resistance value of sensor RS in sensing section 20 varies according to cooking state. In the case of temperature sensor, the temperature varies in accordance with cooking-state and the variation of temperature can be detected as that of resistance value of the sensor. So, output voltage of sensor RS corresponds to the value of [the supply voltage Vcc×load resistance R14]+[sensor resistance RS+load resistance R14] and is supplied to analog/digital conversion input terminal AD of microcomputer 10 to be digital-converted. Then, microcomputer 10 determines a cooking state by the output value of sensor.

The current cooking state determined as above is displayed in characters, figures and/or graphics. That is, microcomputer 10 provides cooking state displaying signals through first and second LED driving terminals P10 to P16, P20 and P21. And those output signals are combined by transistor arrays 31 and 32 and then are supplied to LED displayers 33 and 34. Therefore, the cooking state can be displayed.

For example, if the output of terminal P10 in microcomputer 10 becomes "low", the output of the corresponding transistor in transistor array 31 becomes "high" and a positive voltage is sequentially applied to corresponding LEDs in LED displayers 33 and 34. At the same time, if the output of terminal P20 in microcomputer 10 becomes "high" the output of the corresponding transistor in transistor array 32 becomes "low". Accordingly, the LED in LED displayer 31 to which the positive voltage is applied is lit up so that a cooking state can be displayed in characters or figures.

Meanwhile, when cooking is completed, the output of buzzer control terminal BZ in microcomputer 10 becomes "high". Accordingly, transistors Q2 and Q1 are sequentially turned on and thus voltage Vcc having passed through resistor R6 is applied to buzzer 41. Then, a buzzer sound for indicating the completion of cooking is generated.

However, since the conventional displaying apparatus is installed on the front side of a microwave oven, a user may not realize the cooking state or completion while the user watches television or is otherwise occupied. Moreover, even though a user is separated from a microwave oven during cooking, a cavity lamp for indicating a cooking state is still on so that power is unnecessarily consumed.

SUMMARY OF THE INVENTION

It is an object of the present invention to provide a cooking state displaying apparatus and method for a microwave oven combined with a TV which can selectively display the current cooking state and completion on an LED displayer in microwave oven or on a TV screen in accordance with the result of detecting if there is a user near the microwave oven during cooking.

It is another object of the present invention to provide a cooking state displaying apparatus and method which can save power consumption by selectively turning on/off a cavity lamp in accordance with the result of detecting if there is a user near the microwave oven during cooking.

It is still another object of the present invention to provide a cooking state displaying apparatus and method which can efficiently indicate the completion of cooking by varying the loudness of the buzzer sound in accordance with the result of detecting if there is a user near the microwave oven when the cooking is completed.

In order to achieve the above objects, there is provided a cooking state displaying apparatus for a microwave oven combined with a television, comprising:

first sensing means for sensing the current cooking state and completion;

means, built in the microwave oven, for displaying the current cooking state and completion;

second sensing means for sensing if there is a person near the microwave oven during cooking, and providing a body sensing signal;

second control means for controlling the display of the current cooking state and completion on the television screen;

means for generating a buzzer sound for indicating the completion of cooking when the cooking is completed; and first control means for controlling the second control means to display the current cooking state and completion on the television screen if no body sensing signal is provided from the second sensing means, and controlling the display means to display the current cooking state and completion on the display means if the body sensing signal is provided.

In order to achieve the above objects, there is also provided a cooking state displaying method for a microwave oven combined with a television, comprising the steps of:

determining the current cooking state and completion during cooking;

determining if there is a person near the microwave oven during cooking;

displaying the current cooking state and completion on a displayer built in the microwave oven and turning on a cavity lamp while it is sensed that there is a person near the microwave oven;

displaying the current cooking state and completion on a television screen and turning off the cavity lamp while it is sensed that there is no person near the microwave oven; and generating a buzzer sound when it is sensed that the cooking is completed.

BRIEF DESCRIPTION OF THE DRAWINGS

The above object and other advantages of the present invention will become more apparent by describing the preferred embodiment thereof with reference to the accompanying drawings, in which:

FIGS. 7A to 7C are waveform diagrams explaining data transmission in relation to the circuit of FIG. 3.

DETAILED DESCRIPTION OF PREFERRED EMBODIMENT

Figure 3:
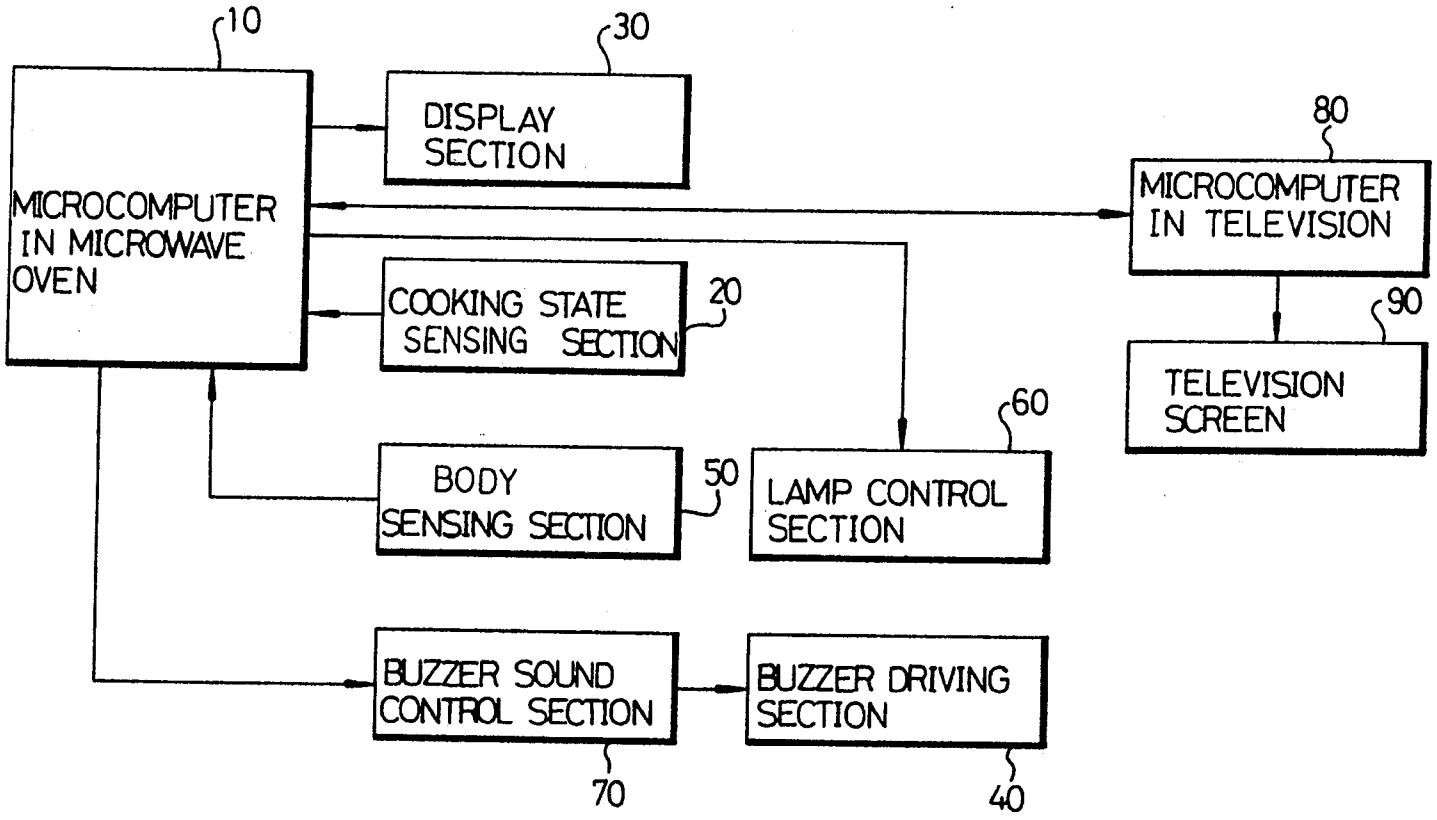
FIG. 3 is a block diagram of the present cooking state displaying apparatus according to the present invention.

With reference to FIG. 3, the present apparatus comprises microcomputer 10 in a microwave oven for controlling the cooking system of the microwave oven, cooking state sensing section 20 for sensing a cooking state to provide the sensed signal to microcomputer 10, and display section 30 for displaying the current cooking state and completion, driven by the cooking displaying signal outputted from microcomputer 10.

The present apparatus also includes a body-sensing section 50 for sensing if there is no person near the microwave oven during automatic cooking to provide the sensed signal to microcomputer 10, and microcomputer 80 in a TV for controlling the display of the current cooking state and completion on TV screen 90 by executing data transmission/reception with microcomputer 10 in a microwave oven in accordance with the outputs of body-sensing section 50 and cooking state sensing section 20.

The present apparatus further comprises lamp control section 60 for turning on/off a cavity lamp under the control of microcomputer 10 in a microwave oven according to the output of body sensing section 50, buzzer driving section 70 for generating a buzzer sound to indicate the completion of cooking under the control of microcomputer 10 in a microwave oven, and buzzer sound control section 70 for controlling the output level of buzzer driving section 40 under the control of microcomputer 10 in a microwave oven according to the output of body-sensing section 50 and on/off state of TV.

Figure 4:
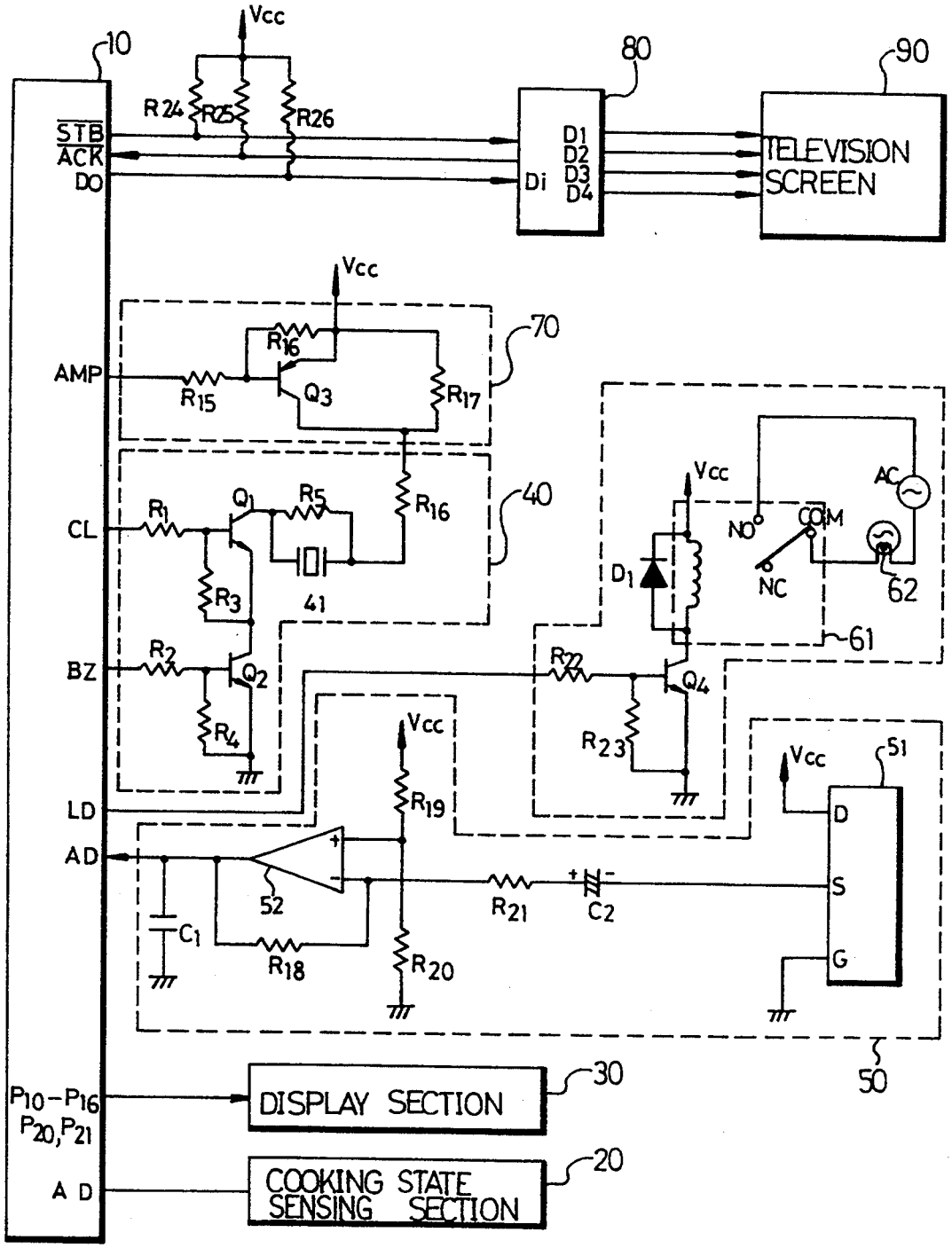
FIG. 4 is an embodied circuit diagram of the apparatus in FIG. 3.

As shown in FIG. 4, body-sensing section 50 comprises body sensor 51, operational amplifier 52 for amplifying the output signal of body sensor 51 to provide the amplified signal to A/D conversion input terminal of microcomputer 10 in a microwave oven, voltage dividing resistors R19 and R20, resistors R18 and R21 and capacitors C1 and C2. Buzzer sound control section 70 comprises transistor Q3 driven by the buzzer sound control output of microcomputer 10 in a microwave oven, for controlling the driving voltage which will be supplied to buzzer driving section 40, and bias resistors R15 to R17. Lamp control section 60 comprises relay 61 for switching AC (Alternating Current) power supply which will be applied to cavity lamp 62, transistor Q4 for driving relay applied to cavity lamp 62, transistor Q4 for driving relay 61 according to the lamp control output of microcomputer 10 in a microwave oven, diode D1 for free-wheeling and bias resistors R22 and R23. Microcomputer 10 in a microwave oven is connected to microcomputer 80 in a TV and executes data transmission/reception through stand-by terminal $\overline{STB}$, acknowledge terminal $\overline{ACK}$, and data output terminal D0. And microcomputer 80 in a TV is connected to TV screen 90 through screen control terminals D1 to D4.

The cooking state displaying apparatus and method according to the present invention will be explained in detail as follows.

Figure 5:
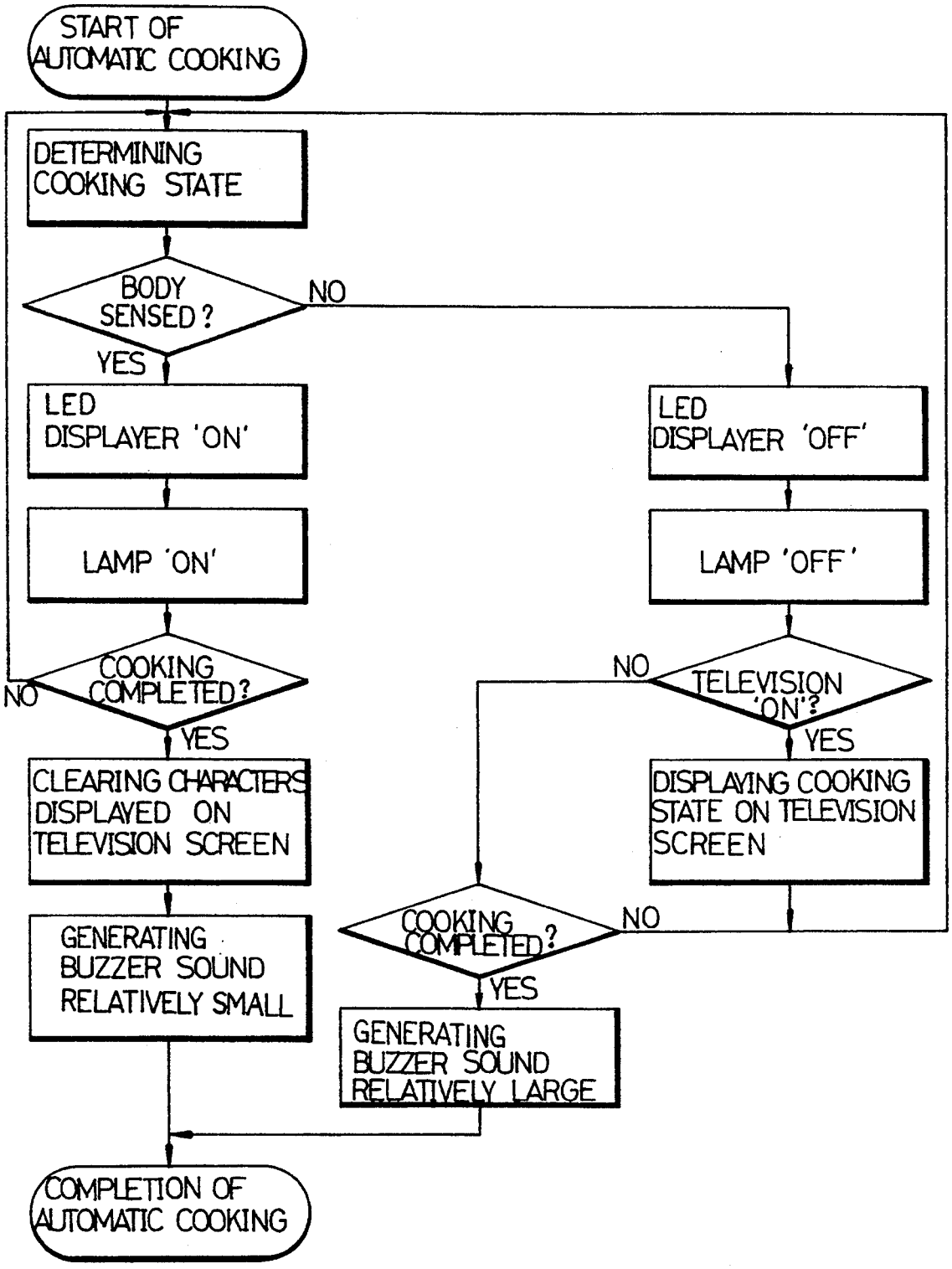
FIG. 5 shows an algorithm to which the cooking state displaying method according to the present invention is applied.

Referring to FIG. 4 and FIG. 5, if automatic cooking mode is selected, microcomputer 10 in a microwave oven determines the current cooking state by output signal from cooking state sensing section 20.

Figure 6:
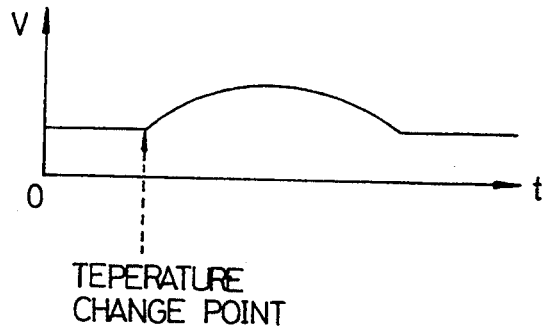
FIG. 6 is an output voltage waveform diagram of the body sensor in FIG. 4.
Figure 6:
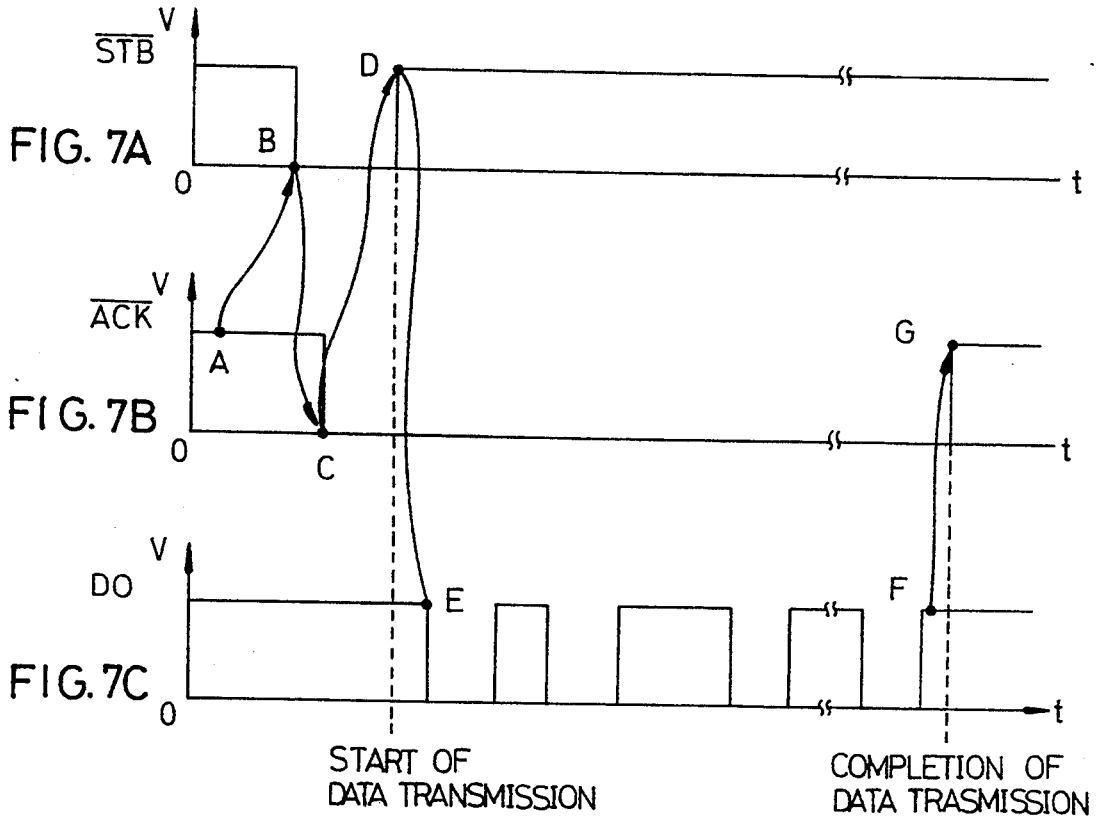

Meanwhile, body sensor 51 in body-sensing section 50 detects the variation of temperature generated when a person comes near to the front side of a microwave oven, and outputs a voltage signal having a waveform like that of FIG. 6 from output terminal S thereof. The outputted voltage signal is amplified as much as amplification ratio R18/R21 through operational amplifier 52 and then is supplied to A/D conversion input terminal AD of microcomputer 10 in a microwave oven. Accordingly, microcomputer 10 in a microwave oven can determine, in accordance with output of body sensing section 50, if there is a person near the front side of a microwave oven.

Figure 1:
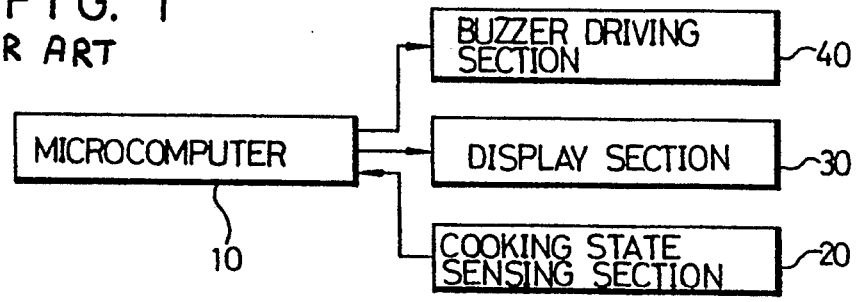
FIG. 1 PRIOR ART
FIG. 1 is a block diagram of the conventional cooking state displaying apparatus.
Figure 2:
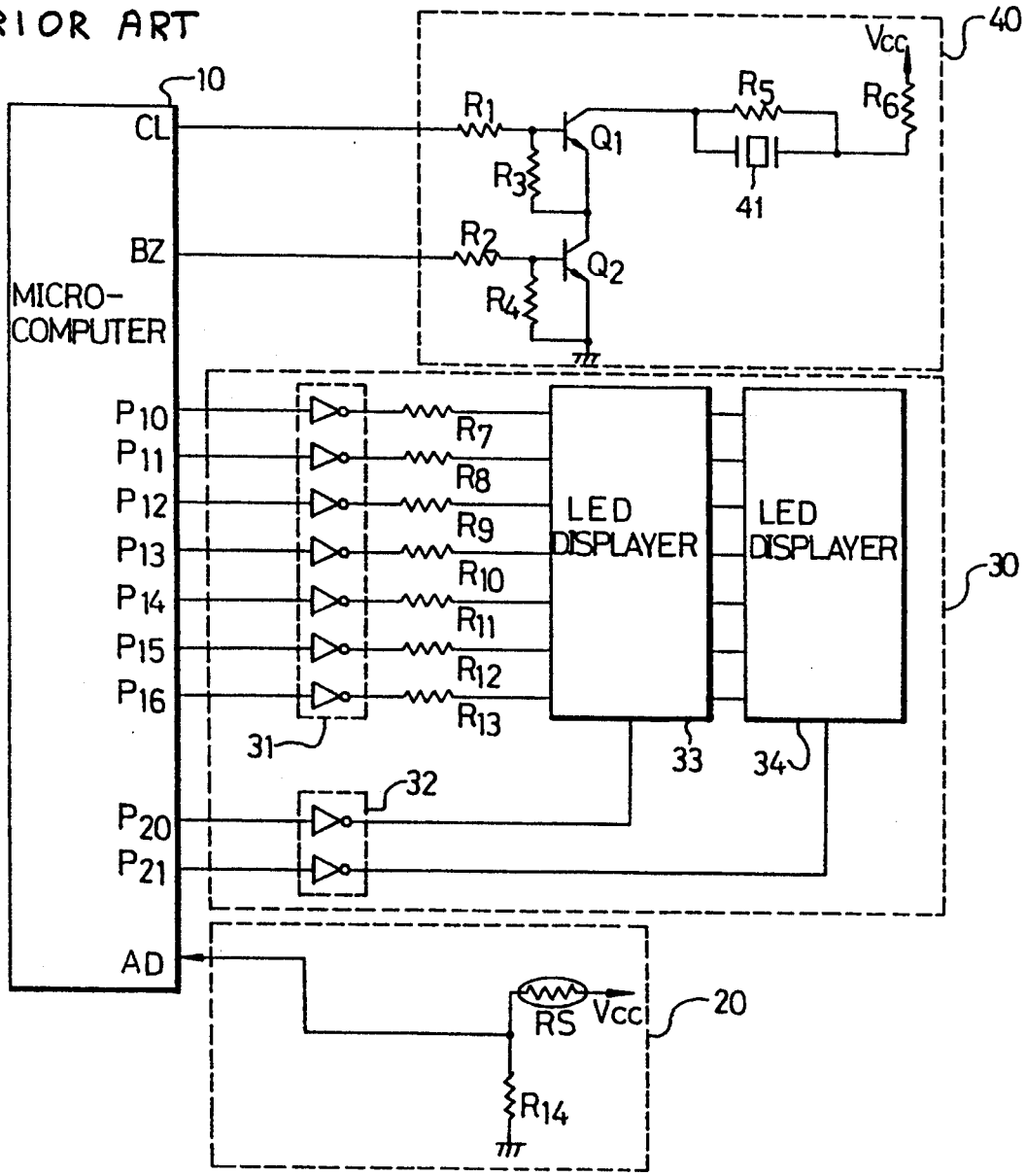
FIG. 2 PRIOR ART
FIG. 2 is a detailed circuit diagram of the apparatus in FIG. 1.

At this time, if it is determined that there is a person nearby, microcomputer 10 in a microwave oven provides a cooking state displaying signal corresponding to the output of cooking state sensing section 20, thereby turning on LED displayer 33 and 34 (shown in FIG. 2) in display section 30 and providing a "high" level signal through lamp control terminal LD thereof. Accordingly, transistor Q4 in lamp control section 60 is turned on and relay 61 is driven so that contact COM of relay 61 is connected to contact NO from contact NC. Therefore, cavity lamp 62 in a microwave oven is lit up.

Meanwhile, if it is determined that there is no person nearby, microcomputer 10 in a microwave oven turns off LED displayer 33 and 34 and cavity lamp 62 according to the operation stated as above.

In addition, if there is a person nearby, microcomputer 10 in a microwave oven determines through cooking state sensing section 20 if the cooking is completed. At this point, if cooking is not completed, microcomputer 10 returns to the step of determining cooking state. And, if cooking is completed, microcomputer 10 clears cooking state displaying characters and symbols on TV screen 90 and generates a weak buzzer sound indicating the completion of cooking through buzzer driving section 40.

As stated above, in order to display or clear cooking state displaying characters and symbols on TV screen 90, data transmission/reception should be performed between microcomputer 10 in a microwave oven and microcomputer 80 in a TV.

FIGS. 7A to 7C show data transmission/reception method between microcomputers 10 and 80 according to the present invention.

First, before microcomputer 10 in a microwave oven transmits data, it checks the output of acknowledge terminal $\overline{ACK}$ of microcomputer 80 in a TV. If output of acknowledge terminal $\overline{ACK}$ is "high" like that of point A in FIG. 7B, microcomputer 10 in a microwave oven makes the output of stand-by terminal $\overline{STB}$ thereof "low" like that of point B in FIG. 7A and then checks if microcomputer 80 in a TV is ready for data reception.

At this time, if microcomputer 80 in a TV is ready for data reception, it provides a "low" level signal like that of point C in FIG. 7B from acknowledge terminal ACK thereof to microcomputer 10 in a microwave oven. Then, microcomputer 10 in a microwave oven makes output of stand-by terminal $\overline{STB}$ thereof "high" like that of point D in FIG. 7A and then provides data on cooking state from data output terminal DO thereof like that of point E in FIG. 7C.

If all data are transmitted like that of point F in FIG. 7C, the output from acknowledge terminal ACK of microcomputer 80 in a TV becomes "high" again like that of point G in FIG. 7B.

If the transmitted data from microcomputer 10 to microcomputer 80 instructs clearing cooking state displaying characters and symbols on TV screen 90, microcomputer 80 in a TV clears TV screen 90 through output terminal D1 to D4 for controlling TV screen 90.

Moreover, in order to generate a buzzer sound with a relatively small signal as stated above, microcomputer 10 in a microwave oven makes the output of buzzer sound control terminal AMP "high" so that the base of transistor Q3 in buzzer sound control section 70 is reverse biased and transistor Q3 is turned off. Accordingly, DC (Direct Current) supply voltage Vcc which will be applied to buzzer 41 in buzzer driving section 40 drops as much as the multiplied value of resistance R17 and load current in buzzer 41, where the value of DC supply voltage which will be applied to buzzer 41 corresponds to {Vcc-(R17 * load current in buzzer)}. At this state, if the output of buzzer control terminal BZ in microcomputer 10 becomes "high" both transistors Q1 and Q2 in buzzer driving section 40 are turned on so that the above dropped buzzer driving voltage is supplied to buzzer 41. Therefore, a buzzer sound with a relatively small signal can be generated.

On the other hand, in order to generate a buzzer sound with a relatively large signal, microcomputer 10 in a microwave oven makes the output of buzzer control terminal AMP "low" so that the base of transistor Q3 in buzzer sound control section 70 is forward biased and the transistor is turned on. Accordingly, DC supply voltage Vcc is directly applied to buzzer 41 in buzzer driving section 40 through transistor Q3. At this state, if the output of buzzer sound control terminal BZ in microcomputer 10 becomes "high", a relatively loud buzzer sound is generated.

After buzzer sound is generated as stated above, automatic cooking ends.

Meanwhile, if there is no person in front of a microwave oven according to body sensing section 50, microcomputer 10 in a microwave oven turns off LED displayer 33 and 34 and cavity lamp 62 and then checks through microcomputer 80 in a TV if the TV is turned on and a user is watching TV at present. That is, after output of stand-by terminal $\overline{STB}$ of microcomputer 10 in a microwave oven becomes "low" as shown in FIG. 7A, if the output of acknowledge terminal $\overline{ACK}$ of microcomputer 80 in a TV does not become "low" during a specified period, it is determined that the TV is turned off. But if the output of acknowledge terminal $\overline{ACK}$ becomes "low" as shown in FIG. 7B within a specified period, the TV is turned on. Thus, it is determined that a user is watching TV.

If it is determined that a TV is turned on, microcomputer 10 in a microwave oven transmits a display instruction corresponding to the current cooking state from data output terminal DO thereof to data input terminal D1 of microcomputer 80 in a TV. Then, microcomputer 80 in a TV displays the cooking state or completion on TV screen through screen control terminals D1 to D4, by printing pixels with a specific color at a specific position on the main screen.

Meanwhile, if it is determined that there is no person in front of a microwave oven through body-sensing section 50 and it is determined that a TV is turned off because the output of acknowledge terminal $\overline{ACK}$ of microcomputer 80 in a TV does not become "low" within a specified period, it is regarded as a case where there is no user near the microwave oven during automatic cooking and no one watching TV. In this state, microcomputer 10 in a microwave oven repeatedly checks the completion of cooking through cooking state sensing section 20. When cooking is completed, microcomputer 10 generates a buzzer sound with a relatively larger signal than a buzzer sound generated when a user is near the microwave oven, thereby indicating completion of cooking.

From the foregoing, it will be apparent that, when a user watches TV during automatic cooking with a microwave oven, the present apparatus can display a cooking state through a TV screen, and when a user does not watch TV and is not near the microwave oven, the present apparatus can generate a relatively loud buzzer sound when cooking is completed. Therefore, it is convenient to use and it is possible to obtain a high quality product. Also, it is possible to prevent unnecessary power consumption during automatic cooking.

While the present invention has been described and illustrated herein with reference to the preferred embodiment thereof, it will be understood by those skilled in the art that various changes in form and details may be made therein without departing from the spirit and scope of the invention.

What is claimed is:

1. A cooking state displaying apparatus for a microwave oven combined with a television set, comprising:

first sensing means for sensing the current cooking state and completion;

displaying means, built in said microwave oven, for displaying the current cooking state and completion;

second sensing means for sensing if there is a person near said microwave oven during cooking, and providing a body sensing signal;

second control means for controlling display of the current cooking state and completion on a television screen;

means for generating a buzzer sound for indicating the completion of cooking when cooking is completed; and first control means for controlling said second control means to display the current cooking state and completion on said television screen if body sensing signal is not provided from said second sensing means, and controlling said displaying means to display the current cooking state and completion of the current cooking state and completion on said displaying means if the body sensing signal is provided.

2. The cooking state displaying apparatus as claimed in claim 1, wherein said first control means is a microcomputer in said microwave oven and said second control means is a microcomputer in said television set.

3. The cooking state displaying apparatus as claimed in claim 1, further comprising:

a lamp for lightening a heating cavity of said microwave oven; and means for turning on said lamp under the control of said first control means only when the body sensing signal is provided to said first control means.

4. The cooking state displaying apparatus as claimed in claim 1, further comprising:

means for determining whether said television set is turned on or off; and buzzer sound control means for controlling said buzzer sound generating means to generate relatively loud buzzer sound under the control of said first control means if it is determined that said television set is turned off and said body sensing signal is not provided from second sensing means when cooking is completed.

5. A cooking state displaying method for a microwave oven combined with a television set, comprising the steps of:

determining the current cooking state and completion during cooking;

determining if there is a person near the microwave oven during cooking and displaying the current cooking state and completion of a display which is built in the microwave oven and turning on a cavity lamp while there is a person near the microwave oven;

displaying the current cooking state and completion on a television screen and turning off the cavity lamp while there is no person near the microwave oven; and generating a buzzer sound in the microwave when cooking is completed.

6. The cooking state displaying method as claimed in claim 5, further comprising the steps of:

determining whether said television set is turned on or off; and generating a relatively louder buzzer sound, if cooking is completed and when it is determined that said television set is turned off, and generating a relatively weak buzzer sound when it is determined that said television set is turned on.

* * * * *